United States Patent [19]

Gaysert

[11] 4,350,664

[45] Sep. 21, 1982

[54] CATALYTIC CONVERTER FOR TREATMENT OF THE EXHAUST GASES OF INTERNAL COMBUSTION ENGINES

[75] Inventor: Gerhard Gaysert, Esslingen am Neckar, Fed. Rep. of Germany

[73] Assignee: J. Eberspächer, Fed. Rep. of Germany

[21] Appl. No.: 626,616

[22] Filed: Oct. 28, 1975

Related U.S. Application Data

[63] Continuation of Ser. No. 393,665, Aug. 31, 1973, abandoned.

[30] Foreign Application Priority Data

Sep. 9, 1972 [CH] Switzerland ..... 12966/72

[51] Int. Cl.[3] ..... F01N 3/15; B01J 8/06

[52] U.S. Cl. ..... 422/179; 422/180

[58] Field of Search ..... 23/288 FC; 60/299; 138/112; 422/179, 180

[56] References Cited

U.S. PATENT DOCUMENTS

| | | | |
|---|---|---|---|
| 2,807,930 | 10/1957 | Bratton | 23/288 FC UX |
| 3,441,381 | 4/1969 | Keith et al. | 23/288 FC |
| 3,503,716 | 3/1970 | Berger | 23/288 FC UX |
| 3,597,165 | 8/1971 | Keith et al. | 23/288 FC |
| 3,687,224 | 8/1972 | Lundin | 181/72 X |
| 3,692,497 | 9/1972 | Keith et al. | 23/288 FC |
| 3,798,006 | 3/1974 | Balluff | 23/288 FC |
| 3,801,289 | 4/1974 | Wiley | 23/288 FC |
| 3,841,842 | 10/1974 | Wiley | 23/288 FC |
| 3,854,888 | 12/1974 | Fnetzsche et al. | 23/288 FC |
| 3,891,396 | 6/1975 | Musall et al. | 23/288 FC X |
| 3,895,917 | 7/1975 | Ravault | 23/288 FC X |
| 3,945,803 | 3/1976 | Musall et al. | 23/288 FC |

FOREIGN PATENT DOCUMENTS

| | | | |
|---|---|---|---|
| 791117 | 7/1968 | Canada | 23/288 FC |

*Primary Examiner*—Barry S. Richman

*Attorney, Agent, or Firm*—McGlew and Tuttle

[57] ABSTRACT

A catalytic converter for treating exhaust gases of internal combustion engines comprises a housing having a passage therethrough for the passage of the gases and a monolithic ceramic honeycomb forming a catalyst carrier located within the housing. The honeycomb is held in spaced location from the interior walls of the housing by at least one elastic element of compacted mesh material such as a compacted metal mesh.

3 Claims, 7 Drawing Figures

CATALYTIC CONVERTER FOR TREATMENT OF THE EXHAUST GASES OF INTERNAL COMBUSTION ENGINES

This is a continuation of application Ser. No. 393,665 filed Aug. 31, 1973, and now abandoned.

BACKGROUND OF THE INVENTION

1. Field of the Invention

This invention relates in general to devices for treating exhaust gases and, in particular, to a new and useful catalytic converter for the treatment of exhaust gases of internal combustion engines which includes a monolithic ceramic honeycomb structure supported within a housing in and a flow passage for the gases by a compacted mesh material disposed between the honeycomb and the housing and holding the honeycomb in position.

2. Description of the Prior Art

The present invention is particularly concerned with the construction of catalyst converters which are connected to the exhaust conduits of internal combustion engines in order to reduce the harmful or polluting substances contained in the exhaust gases. The polluting substances particularly include carbon monoxide, unburnt or partly burnt hydrocarbons (CxHy) as well as nitric oxides. It is known that catalysts can be used with advantage to convert these harmful substances into unharmful emissions. The known exhaust gas catalysts include ceramic porous carriers having surfaces over which a catalytically active substance such as platinum is applied and such carriers usually take the form of small cylindrical or spherical pellets. These pellets, usually in dimensions of between 1 and 4 mm in diameter, are embedded in a sheet metal housing provided with perforated sheets which are traversed by the exhaust gas from the engine.

The main disadvantages of the known pellet type catalysts are:

1. The high flow resistance which they produce along with the associated high exhaust gas pressure and this in turn, results in a drop of the maximum attainable engine performance;

2. The relatively high heat capacity of the catalyst which prevents rapid heating to operating temperatures after a cold start of the engine; and 3. The great abrasion of the pellets which materially shortens the life of the known detoxification devices.

It is also known that monolithic carriers which consist of a continuous skeleton of porous ceramic material can be used with advantage. Such elements, which are called honeycombs in the industry, comprise cylindrical blocks of about 100 mm in diameter and are of lengths between 50 and 200 mm. Such dimensions are typical of exhaust gas catalytic systems which are used in European medium sized passenger cars.

The flow channels formed by the skeleton are usually of square or trapezoidal cross section with an inside cross section from between 1 and 32 mm. Thus, several thousand flow channels with substantially constant cross sections are reached in a body of the above-described size. Because of the low wall thickness of a few tenths of a millimeter of their rib structure, the honeycombs have relatively low mechanical strength and are susceptible to mechanical stress by rapidly changing temperatures, particularly thermal shock. The coefficient of thermal expansion is substantially lower than that of the metal used as a holder. For this reason direct mounting of the honeycomb in a rigid sheet metal construction is out of the question. Attempts to embed the honeycomb in a metal housing with an intermediate layer of high temperature resistant ceramic fiber have been made, but the results were not satisfactory. The great pulsation of the exhaust gases with dynamic alternating pressure of several tenths of atmospheres in cooperation with the high temperature gases of 800° C. or more, destroys the ceramic fiber within a few operating hours.

SUMMARY OF THE INVENTION

In accordance with the present invention, there is provided a catalytic converter for the treatment of exhaust gases of internal combustion engines which includes a monolithic ceramic honeycomb which forms a catalyst carrier. The honeycomb is supported within the housing by compact metal mesh material disposed between the honeycomb and the housing. The compact metal mesh material has sufficient elasticity at the temperatures which occur in the operation to maintain the honeycomb in a proper operating position. It is also capable of absorbing stresses caused by differences in thermal expansion between the housing and the honeycomb. In addition, it is capable of dealing with stresses caused by the mechanical actions of the gas forces and the inertia forces due to vibrations. The construction is such that it also ensures that the amount of gas which passes through the honeycomb is withdrawn from the catalytic treatment and is kept as low as possible.

A material which is suitable as a material for the elastic support of a honeycomb within the housing is an especially shaped and treated compact metal mesh or knitting. A similar arrangement can also be effected by a resilient metal bellows bearing between the honeycomb and the housing. The metal bellows can be obtained as an elastic bed in connection with one or several ceramic rings arranged on the pressure sensitive honeycomb and which serves to introduce the holding forces. The metal bellows can also be replaced by a system of cup springs.

The inventive arrangement ensures that the forces exerted by a housing on the honeycomb will remain within limits of the surface pressure admissible for honeycomb structures even under unfavorable mechanical and thermal conditions, and it will also ensure a frictional connection and support of the honeycomb from the housing. The structure is such that play between the housing and the honeycomb which will lead to the destruction of the honeycomb within a very short time due to exhaust gas pulsation, will not take place.

Accordingly, it is an object of the invention to provide an improved catalytic converter for the treatment of exhaust gases of internal combustion engines which includes a housing for the passage of the gases having a monolithic ceramic honeycomb forming a catalyst carrier therein and at least one elastic element of compacted mesh material disposed between the honeycomb and the housing and holding the catalyst carrier in position.

A further object of the invention is to provide a catalyst converter which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENTS

Figure 1:
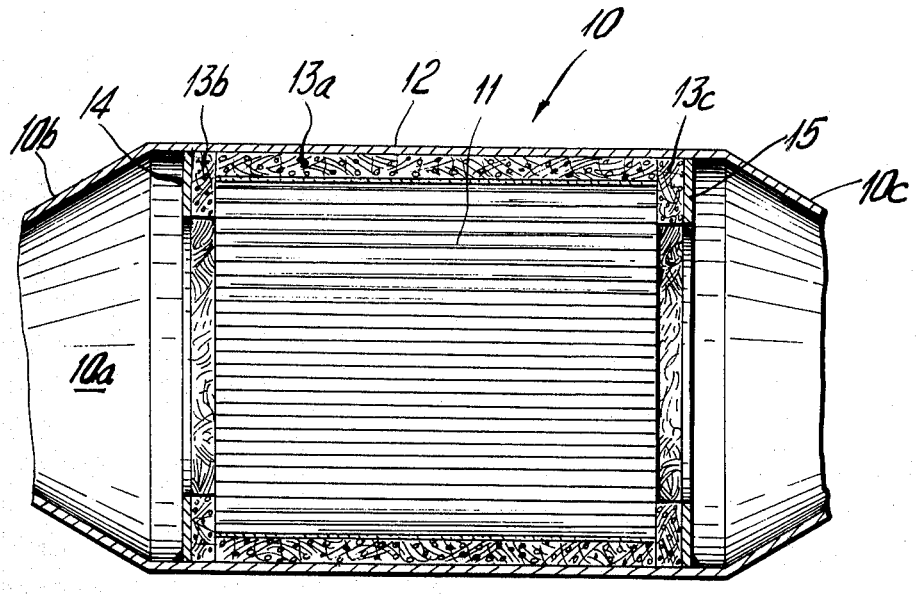
FIG. 1 is a longitudinal sectional view of a catalytic gas converter for attachment to an exhaust conduit of an automobile constructed in accordance with the invention.

Referring to the drawings in particular, the invention embodied therein in FIG. 1 comprises a housing generally designated 10 having a central flow passage 10*a* for the passage of exhaust gases from an internal combustion exhaust line through an entrance end 10*b* and out through a discharge end 10*c*.

In accordance with the invention, a monolithic catalyst carrier in the form of a ceramic honeycomb 11 is secured within a central uniform diameter housing portion 12 of the housing 10 so as to be embedded within three molded bodies of compacted metal or wire mesh material, namely a central sleeve portion or damping ring 13*a* and relatively narrow end rings or collar portions 13*b* and 13*c* arranged at the respective ends. The parts 13*a*, 13*b* and 13*c* are advantageously of an elastic material and embrace the honeycomb so as to form an axial and radial support therefor and it comprises a high temperature resistant wire, for example, a metal material designated 2.4969. The metal alloy used for these parts 13*a*, 13*b* and 13*c* provides adequate spring qualities to resiliently hold the honeycomb 11 even in temperature ranges up to 900° C. The molded bodies 13*a*, 13*b* and 13*c* are prestressed both radially and axially during the final assembly and before they are secured in a central position within the uniform diameter portion 12 of the housing 10 by stop disks 14 and 14 which are welded at the respective ends.

Figure 2:
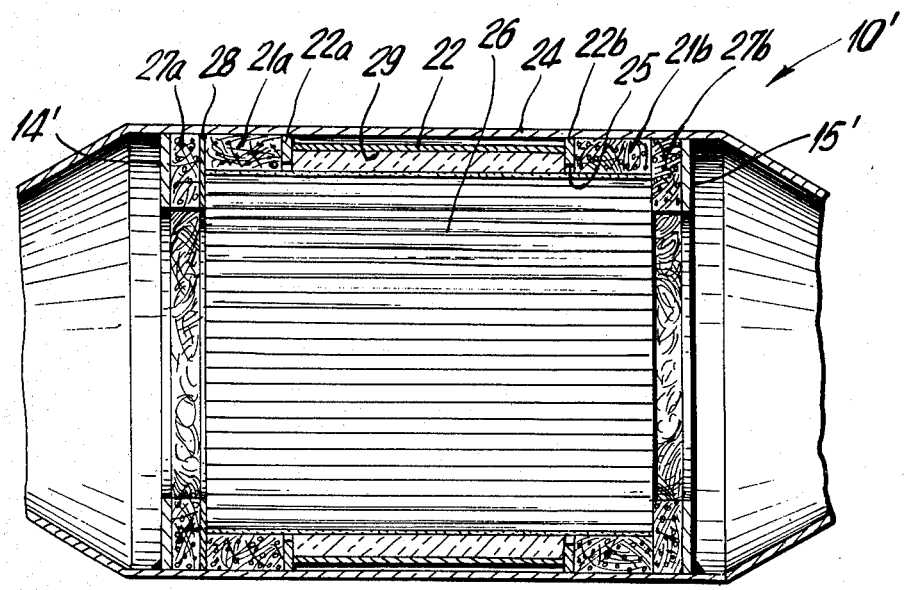
FIGS. 2–7 are views similar in FIG. 1 of other embodiments of the invention.

In the embodiment of FIG. 2, the catalytic converter 10' includes a central uniform diameter housing 24 which is filled with a honeycomb 26 forming a catalytic carrier. In this construction the honeycomb 26 is supported by axially spaced end parts 21*a* and 21*b* of the compacted metal mesh which ensures the radial holding of the honeycomb. The end parts 21*a* and 21*b* are separated and kept apart by a spacer 22 which includes end disks 22*a* and 22*b*. The spacer is displaceable in the housing 24 and there is a small radial gap 25 between the honeycomb 26 and each end disk 22*a* and 22*b*. This ensures that there is no cutting of the honeycomb by the end disks. A gasket 28 is arranged between the elastic support elements 21*a* and 21*b* and end elastic support members 27*a* and 27*b* which extend over each end of the honeycomb 26 and form an axial support. A space 29 formed between the honeycomb 26 and the spacer 22 with its end disk 22*a* and 22*b* is advantageously filled with a heat insulation material and also with a sealing material.

Figure 3:
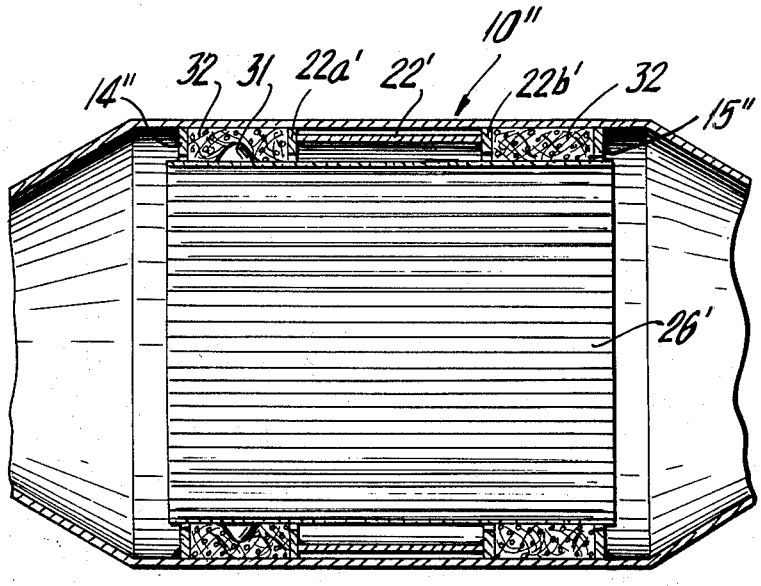

In the embodiment of FIG. 3 a catalytical converter housing 10'' includes two axially spaced elastic support collars or rings 32 and 32' with at least one of them being engaged by an annular bead formation or protuberance formed as a continuation of the ceramic material forming the honeycomb 26'. The bead 31 insures a form-closed conncted between the honeycomb 26' and the elastic support elements 32. In this embodiment, stop disks 14'' and 15'' are advantageously provided at each end of the structure but the construction does not require the axially extending elastic support elements which extend beyond the edges of the honeycomb 26'' as in the other embodiments.

Figure 4:
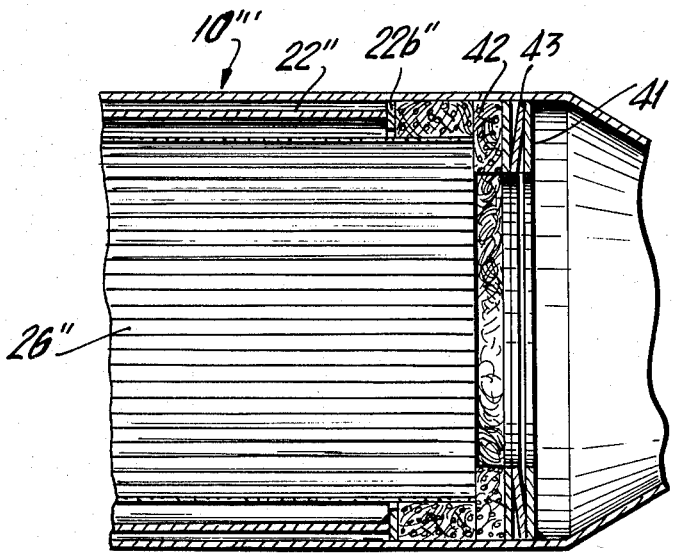

In FIG. 4 a housing 10''' forming a catalytic converter includes an arrangement of a plurality of resilient cup springs 43 of high temperature resistant material arranged between a stop disk 41 welded to the housing and an end resilient support member 42 which covers a portion of the end of the honeycomb 26''. This embodiment is particularly applicable for high stress use in the case that the compact metal knitting should begin to settle after a long period of use. The cup springs 43 are arranged so that there is still sufficient travel reserve permitted under initial stress.

Figure 5:
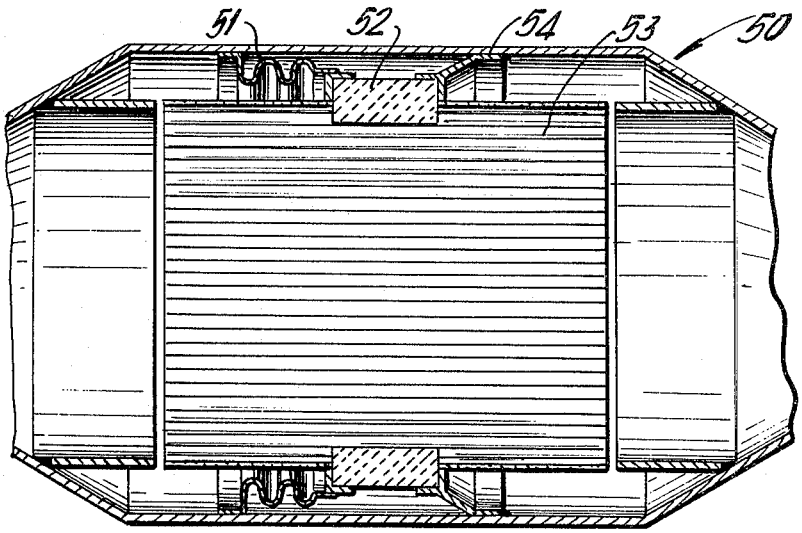

In the embodiment shown in FIG. 5, a catalytic converter housing generally designated 50 has a flow passage which is filled with a honeycomb 53 forming a catalytic material carrier. In this embodiment a siphon 51 is employed as a resilient element. A ring 52 which is divided on its circumference and which is of a special ceramic material particularly resistant to thermal shock is inserted into a groove of the honeycomb which is defined around its surface intermediate its length. The ring 52 is cemented to the honeycomb by means of a refractory cement. The ring 52 forms a relatively pressure resistant defined bearing surface for the transmission of the axial tractive forces which are exerted on the honeycomb 53 by the bellows wall or siphon 51 at one end thereof, or by the counter stop wall 54 at the other end which is welded to the interior of the housing 50.

Figure 6:
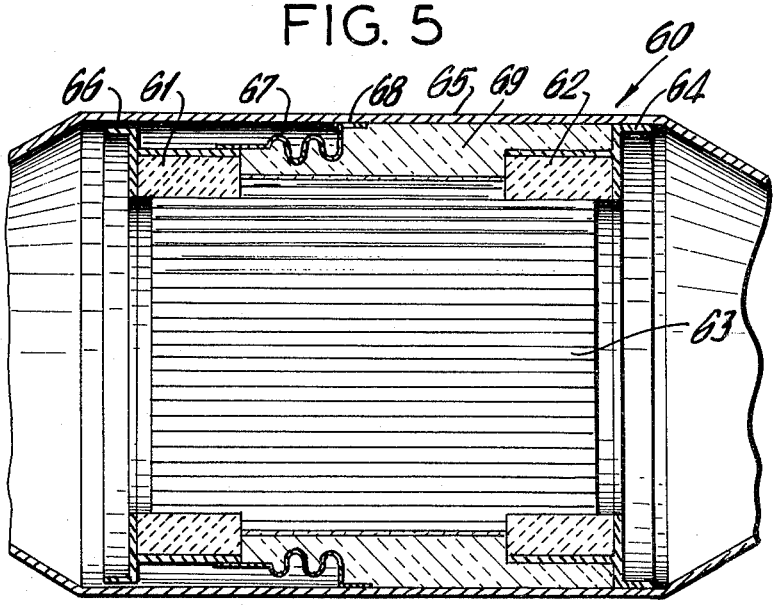

In the embodiment shown in FIG. 6, a housing 60 is filled with a honeycomb 63 forming a catalyst carrier which has an end with a groove carrying a ring 62 of ceramic material and it abuts against a stop ring 64 which is welded within the housing uniform diameter portion 65. A stop ring 66 arranged at the other end includes a flange which is spaced from the interior of the housing 60 or which glides over the interior surface so that it can move freely in an axial direction. An initial stressings exerted on the honeycomb 63 is absorbed by the expansion of the bellows 67 which is welded to the interior wall of the housing 65 at the location 68. A space is formed between the honeycomb 63, the bellows 67 and the housing 65 and the stop ring 64 which is formed with a heat insulating material 69 and preferably a ceramic fiber is used for this purpose, and in this way the heat transfer from the hot honeycomb to the bellows by convection and radiation is reduced.

Figure 7:
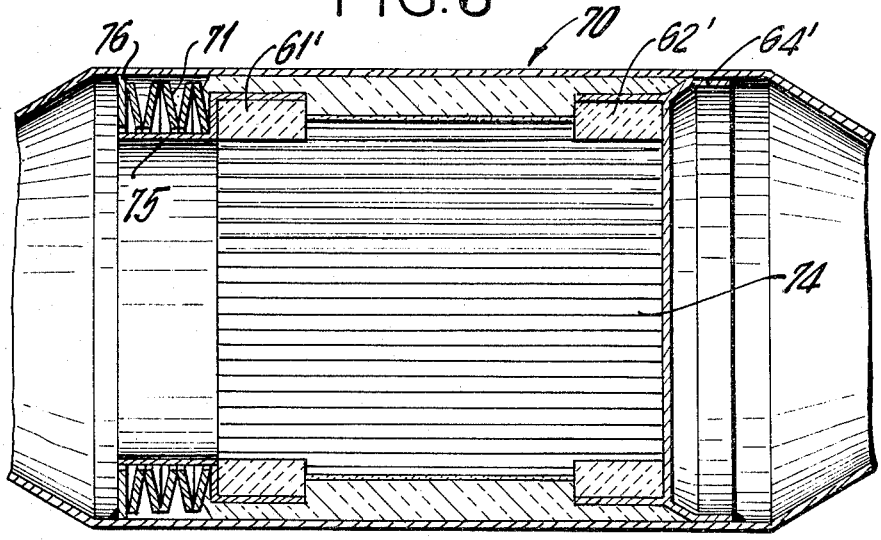

In the embodiment shown in FIG. 7, there is a catalytic converter housing generally designated 70 having a honeycomb therein 74 forming a catalyst carrier which is supported by end elastic bodies 61' and 62', one of which is secured by a plate 64' which is welded at its outer end to the housing, and the other of which is secured by an element 75 which bears against cup springs 71 which in turn are retained by a stop disk 76 which is welded to the housing 70.

While specific embodiments of the invention have been shown and described in detail to illustrate the application of the principles of the invention it will be understood that the invention may be embodied otherwise without departing from such principles.

What is claimed is:

1. A catalytic converter for the treatment of exhaust gases of internal combustion engines comprising:

a housing defining an axial flow passage for the exhaust gases having an annular interior wall with an entrance end and an opposite discharge end;

a monolithic ceramic honeycomb forming a catalyst carrier disposed in said flow path having exterior walls spaced radially inwardly of said-interior wall of said housing;

a metal stop disc having an opening of a size smaller than an axial cross-sectional size of said catalyst carrier connected to said interior wall of said housing and extending radially thereof into said flow passage and axially spaced from said catalyst carrier at said housing entrance end and opposite discharge end;

at least one first high temperature resistant compacted metal wire mesh disposed in the space between said carrier exterior wall and said housing interior wall adjacent said flow passage entrance and opposite discharge ends;

a second high temperature resistant compacted metal wire mesh disposed in the axial spacing between said catalyst carrier and each metal stop disc adjacent said flow passage entrance and discharge ends; and a radially extending gasket disposed between said at least one first wire mesh and said second wire mesh at said flow passage entrance end for blocking a passage of exhaust gases through said at least one first wire mesh.

2. A catalytic converter according to claim 1, wherein said high temperature resistant compacted wire mesh is made of high nickel content alloy wire.

3. A catalytic converter according to claim 1, including a separate first wire mesh positioned adjacent said entrance and discharge end of said flow passage and spacer means for establishing and maintaining a spacing between said first wire mesh adjacent each of said entrance and discharge ends.

* * * * *